US006672859B1

(12) United States Patent
Rabovitser et al.

(10) Patent No.: US 6,672,859 B1
(45) Date of Patent: Jan. 6, 2004

(54) METHOD AND APPARATUS FOR TRANSVERSELY STAGED COMBUSTION UTILIZING FORCED INTERNAL RECIRCULATION

(75) Inventors: Iosif K. Rabovitser, Skokie, IL (US); Richard A. Knight, Brookfield, IL (US); David F. Cygan, Villa Park, IL (US)

(73) Assignee: Gas Technology Institute, Des Plaines, IL (US)

( * ) Notice: Subject to any disclaimer, the term of this patent is extended or adjusted under 35 U.S.C. 154(b) by 0 days.

(21) Appl. No.: 10/222,180

(22) Filed: Aug. 16, 2002

(51) Int. Cl.[7] ..... F23M 3/00; F23M 3/02; F23M 3/04

(52) U.S. Cl. ..... 431/9; 431/8; 431/10; 431/116

(58) Field of Search ..... 431/9, 8, 10, 116

(56) References Cited

U.S. PATENT DOCUMENTS

| | | | | |
|---|---|---|---|---|
| 3,837,788 A | | 9/1974 | Craig et al. | |
| 4,004,875 A | | 1/1977 | Zink et al. | |
| 4,007,001 A | | 2/1977 | Schirmer et al. | |
| 4,021,188 A | * | 5/1977 | Yamagishi et al. | 431/158 |
| 4,395,223 A | | 7/1983 | Okigami et al. | |
| 4,575,332 A | * | 3/1986 | Oppenberg et al. | 431/9 |
| 4,629,413 A | * | 12/1986 | Michelson et al. | 431/9 |
| 5,044,932 A | | 9/1991 | Martin et al. | |
| 5,092,761 A | * | 3/1992 | Dinicolantonio | 431/115 |
| 5,554,021 A | * | 9/1996 | Robertson et al. | 431/9 |
| 6,450,799 B1 | * | 9/2002 | Mahoney et al. | 431/8 |

* cited by examiner

*Primary Examiner*—Alfred Basichas
(74) *Attorney, Agent, or Firm*—Mark E. Fejer

(57) ABSTRACT

An apparatus for combustion of a fuel in stages having at least one wall enclosing a chamber and forming at least one fuel inlet opening, at least one oxidant inlet opening and a plurality of fuel/oxidant outlet openings. A recirculation sleeve is disposed on the fuel/oxidant outlet side of the chamber and is coaxially aligned with the center axis of the apparatus. A plurality of fuel distributors are disposed within the chamber, each fuel distributor having a fuel inlet and a plurality of fuel outlets, each of the fuel outlets being aligned with a corresponding one of the fuel/oxidant outlet openings. Also disclosed is a method for combustion of a fuel in stages.

55 Claims, 8 Drawing Sheets

METHOD AND APPARATUS FOR TRANSVERSELY STAGED COMBUSTION UTILIZING FORCED INTERNAL RECIRCULATION

BACKGROUND OF THE INVENTION

1. Field of the Invention

This invention relates to a fuel staged burner for boilers and other process heating equipment such as hot water generators, steam flood heaters, fluid heaters, furnaces, radiant tubes, or kilns which are fueled by gaseous or liquid fuels, which burner is designed to reduce the formation of nitrogen oxides ($NO_x$) simultaneously with complete combustion at low excess oxidant (overall stoichiometric ratios not exceeding 1.25). The burner provides fuel to the boilers and other process heating equipment in stages that are transversely oriented with respect to the center axis of the burner. This design results in lower levels of $NO_x$ in the flue gases than comparable burner designs without staging. This burner provides several advantages in comparison to burners that provide longitudinally oriented stages relative to the center axis of the burner, including the introduction of secondary or tertiary or quaternary fuel-oxidant mixtures at a lower temperature (not preheated), resulting in lower $NO_x$ levels during and after combustion; fewer apparatus components extending into the combustion chamber, resulting in lower manufacturing and maintenance costs; and avoidance of complex ducting and cooling means to avoid overheating of the staged fuel-oxidant mixtures.

2. Description of Related Art

Conventional combustion of fossil fuels produces elevated temperatures which promote complex chemical reactions between oxygen and nitrogen, forming various oxides of nitrogen as by-products of the combustion process. These oxides, containing nitrogen in different oxidation states, generally are grouped together under the single designation of $NO_x$. Concern over the role of $NO_x$ and other combustion by-products, such as sulfur oxides, carbon monoxide, total hydrocarbons and carbon dioxide, in numerous environmental problems has generated considerable interest in reducing the formation of these environmentally harmful by-products of combustion.

Natural gas is a clean fuel which can help reduce these emissions. As a result, numerous ultra-low emission, natural gas-fired combustion systems are under development.

Known methods of combustion for reducing $NO_x$ emissions from combustion processes include flue gas recirculation and staged combustion. See, for example, U.S. Pat. No. 4,004,875 which teaches a low $NO_x$ burner for combustion of liquid and gaseous fuels in which the combustion area is divided into at least two stages and the combustion products are recirculated, cooled and reintroduced into the primary combustion zone, resulting in a reduction of $NO_x$ emissions. The secondary combustion air is introduced into a secondary combustion zone downstream of the primary combustion zone in an amount sufficient to complete combustion therein. The fuel and primary combustion air are introduced into a primary combustion zone formed by a burner tile which provides a high-temperature environment for the fuel and air mixture to promote combustion. Except for the opening into the secondary combustion zone, the burner tile is completely surrounded by a steel enclosure forming an annular space around the tile. Thus, as fuel and air are injected into the primary combustion zone, part of the partially combusted fuel and air is recirculated around the outside of the burner tile in the annular space between the tile and the steel enclosure and the back into the upstream end of the primary combustion zone.

U.S. Pat. No. 4,629,413 teaches a low $NO_x$ burner utilizing staged combustion in which a mixture of primary combustion air and fuel is introduced into a primary combustion chamber and secondary combustion air is introduced into the combustion chamber in a manner such that the mixing of the secondary combustion air with the flame generated by the mixture of fuel and primary combustion air is delayed. To further inhibit the formation of $NO_x$ emissions, cooled flue gases are recirculated within the combustion chamber into the fuel-rich combustion zone at the base of the flame, that is, the upstream end of the primary combustion zone.

U.S. Pat. No. 5,044,932 also teaches a process and apparatus for reducing the $NO_x$ content of flue gas effluent from a furnace in which cooled flue gases are internally recirculated from the downstream end of the combustion chamber into the upstream end of the combustion chamber where it undergoes reactions with the flame generated by the fuel and air introduced into the upstream end of the combustion chamber. Flue gas recirculation for mixing with primary combustion air and fuel prior to initiation of combustion is taught by U.S. Pat. No. 5,092,761.

A combustion process producing low $NO_x$ emissions utilizing staged combustion is taught by U.S. Pat. No. 4,007,001 in which 0–65% of the total air required for combustion is introduced into a primary combustion zone and 5–25% of the total air required for combustion is provided to a secondary combustion zone. Both U.S. Pat. No. 4,021,188 and U.S. Pat. No. 3,837,788 teaching staged combustion with less than a stoichiometric amount of air and primary combustion chamber, with additional air being added to the secondary combustion chamber for completion of combustion.

U.S. Pat. No. 4,575,332 teaches staged combustion in a swirl combustor with forced annular recycle of flue gases to the upstream end of the primary combustion zone, and U.S. Pat. No. 4,395,223 teaches staged combustion with excess air introduced into the primary combustion zone with additional fuel being introduced into the secondary combustion zone.

Temperature in the primary and secondary combustion zones of a combustion chamber is a critical parameter by which $NO_x$ emissions from a combustion process can be controlled. By providing less than the stoichiometric requirement of combustion air to the primary combustion zone as taught by the prior art, temperatures within the primary combustion zone are substantially below the temperatures of a primary combustion zone into which a stoichiometric, or more than a stoichiometric, requirement of air is introduced. However, the heat generated in the primary combustion zone in accordance with known combustion processes is conveyed into the secondary combustion zone into which secondary combustion air required for completing combustion of the fuel is introduced. Thus, the net heat within the combustion chamber remains unchanged.

SUMMARY OF THE INVENTION

Accordingly, it is one object of this invention to provide a combustion process which produces low pollutant emissions, in particular, low $NO_x$ emissions.

It is another object of this invention to provide a burner for staged combustion in which staging is carried out laterally or transversely, that is, distributed on a plane perpendicular or normal to the burner axis, also referred to herein as the center or central axis.

These and other objects of this invention are addressed by an apparatus comprising at least one wall enclosing a chamber and forming at least one fuel inlet opening, at least one oxidant inlet opening and a plurality of fuel/oxidant outlet openings. The plurality of fuel/oxidant outlet openings are formed by a portion of the wall disposed on a fuel/oxidant outlet side of the chamber and disposed at at least one radial distance from the center axis of the apparatus. A recirculation element, preferably in the form of a hollow cylinder or sleeve, is disposed on the fuel/oxidant outlet side of the chamber and is coaxially aligned with the center axis. The recirculation sleeve comprises a combustion products inlet end and a recirculated combustion products outlet end with the recirculated combustion products outlet end oriented in the direction of the at least one wall and disposed at a distance therefrom. Disposed within the chamber are a plurality of fuel distributors, each of which has a fuel inlet and a plurality of fuel outlets. Each of the fuel outlets is aligned with a corresponding fuel/oxidant outlet opening. As will be discussed in more detail hereinbelow, each fuel/oxidant outlet opening corresponds to a combustion stage produced by the apparatus.

The objects of this invention are further addressed by a method for combustion of a fuel in which a plurality of fuel streams are introduced into a combustion chamber, with each of the fuel streams penetrating at one of at least two different axial lengths into the combustion chamber. Each axial length corresponds to a fuel stage. An oxidant is introduced into the combustion chamber and the fuel is ignited, resulting in formation of a flame and combustion products. At least a portion of the combustion products is recirculated to a base region of the flame.

BRIEF DESCRIPTION OF THE DRAWINGS

These and other objects and features of this invention will be better understood from the following detailed description taken in conjunction with the drawings, wherein.

DETAILED DESCRIPTION OF THE PRESENTLY PREFERRED EMBODIMENTS

Figure 1:
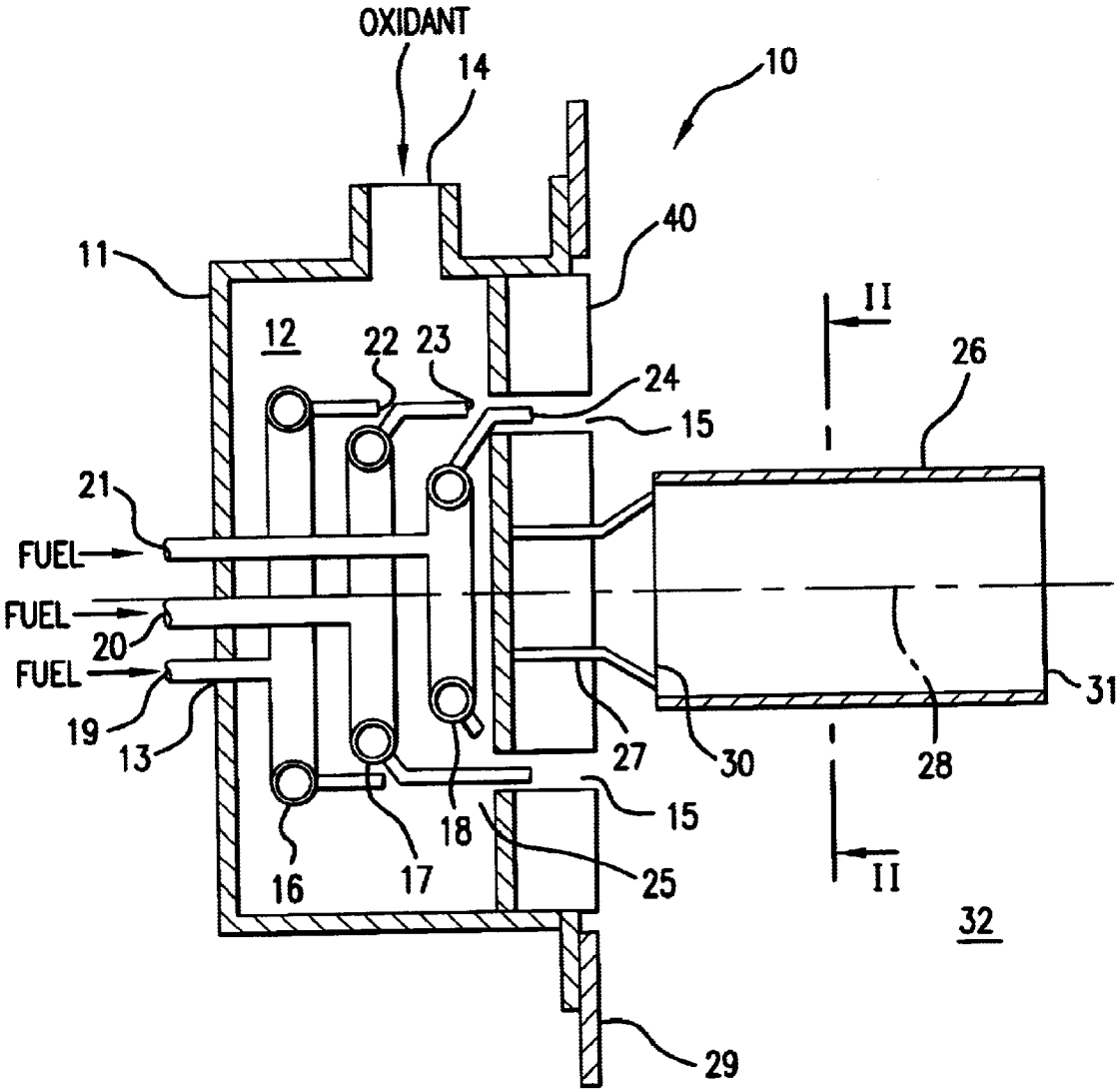
FIG. 1 is a partial cross-sectional side view of a staged combustion burner in accordance with one embodiment of this invention.

The invention disclosed and claimed herein is a method and apparatus for transversely staged combustion utilizing forced internal recirculation that can be applied to steam boilers or processing heating equipment which utilize gaseous or liquid fuels. The applicable fuels include, but are not limited to, natural gas, propane, hydrogen, producer gas, synthesis gas, coke oven gas, blast furnace gas and hydrocarbon liquids. The invention constitutes a method for multi-staged combustion and a burner, of which several preferred embodiments are described hereinbelow. The fuel is delivered by the burner into a combustion chamber in at least two separate streams which constitute stages. The fuel-oxidant streams for all of the stages are introduced into the combustion chamber from essentially the same plane with respect to the burner axis, that is a plane that is normal to the burner axis. It will be apparent to those skilled in the art that the direction in which the fuel-oxidant stream is introduced into may be parallel to the burner axis or at an angle with respect to the burner axis. Introduction of the fuel-oxidant streams into the combustion chamber from essentially the same plane with respect to the burner axis is deemed to exist if at least a portion of each of the fuel/oxidant outlet openings are disposed in essentially the same plane.

The preferred number of stages is three, wherein the fuel and oxidant flows are split approximately as follows. The first stage comprises in the range of about 0 to about 20% of the total amount of fuel consumed by the method and apparatus of this invention with a stoichiometric oxidant-fuel ratio in the range of about 0.3 to 0.5. The second stage comprises in the range of about 30 to about 60% of the total amount of fuel consumed with a stoichiometric oxidant-fuel ratio in the range of about 0.6 to about 0.8. The third stage comprises in the range of about 20 to about 50% of the total amount of fuel consumed with a stoichiometric oxidant-fuel ratio in the range of about 1.4 to about 1.7. It should be noted that while the preferred embodiments of the method and apparatus of this invention employ three stages of fuel input, an arrangement in which one of the stages comprises only oxidant is deemed to be within the scope of this invention.

The fuel-oxidant streams are injected into a combustion chamber by the burner in a manner such that the streams corresponding to the different stages penetrate at different axial lengths into the combustion chamber. The preferred ranges of penetration for a burner having three stages of fuel injection in accordance with this invention are as follows: the first stage stream penetrates in the range of about 5 to about 15% of the length of the combustion chamber; the second stage stream penetrates in the range of about 20 to about 40% of the combustion chamber length; and the third stage penetrates in the range of about 35 to about 55% of the combustion chamber length.

The burner of this invention comprises at least one array of nozzles through each of which fuel, oxidant or fuel and oxidant, either premixed, partially premixed, or nozzle-mixed, flow from a mixing chamber or mixing zone into the combustion chamber. A plurality of nozzles are provided in one or more arrays, preferably circular, ellipsoid or in the form of a rounded rectangle, around the central axis of the burner. Each of the nozzles is associated with one of the stages. In accordance with one preferred embodiment of this invention, all of the nozzles are located at the same radial distance from the burner axis and are distributed such that alternating nozzles belong to different stages. In accordance with another preferred embodiment of this invention, nozzles associated with one or more stages are located at a different radial distance from the burner axis than the nozzles of the remaining stages. In accordance with yet another preferred embodiment of this invention, one or more of the stages are located on one radius with alternating nozzles belonging to different stages and the remaining stages are located on a different radius, also with alternating nozzles belonging to different stages.

Forced internal recirculation is also employed in the method and apparatus of this invention to recirculate combustion products to the region of flame ignition in the combustion zone. This recirculation is caused in part by a fixed component of the burner referred to as a recirculation sleeve which provides three levels of functionality. The first level of functionality is the recirculation of combustion products induced by the kinetic energy of the oxidant-fuel jets. The second level of functionality is the providing of heat transfer by radiation from the combustion zone to the cooler walls of the boiler or other processing heating equipment, thereby reducing the flame temperature and, thus, suppressing $NO_x$ formation. The third level of functionality is stabilization of the flame.

FIG. 1 shows one preferred embodiment of the apparatus of this invention in which three stages are used, nozzle-mixing is used to provide different fuel-oxidant ratios in each of the three stages, all of the nozzles are located on the same radius with respect to the burner axis, the nozzles associated with different stages are distributed circumferentially around the burner axis, and the diameter of the recirculation sleeve is smaller than the radius on which the nozzles are located. More particularly, burner 10 comprises at least one wall 11 enclosing a chamber 12. The at least one wall 11 forms at least one fuel inlet opening 13, at least one oxidant inlet opening 14 and a plurality of fuel/oxidant outlet openings 15. The fuel/oxidant outlet openings 15 are formed by a portion of the wall 11 disposed on a fuel/oxidant outlet side 25, which faces combustion chamber 32 defined by combustion chamber wall 29.

A plurality of fuel distributors 16, 17, 18 are disposed within chamber 12. Each of the fuel distributors 16, 17, 18 includes a fuel inlet 19, 20, 21 and a plurality of fuel outlets 22, 23, 24. Each of the fuel outlets 22, 23, 24 is aligned with one of the fuel/oxidant outlet openings 15. As a result, fuel from fuel distributors 16, 17, 18, as it passes through fuel outlets 22, 23, 24, mixes with oxidant from chamber 12 in the fuel/oxidant outlet openings 15 (also referred to herein as nozzles), thereby providing a mixture of fuel and oxidant to combustion chamber 32 in which the mixture is ignited to form a flame. To protect the burner against heat from the combustion of the fuel in the combustion chamber, the outer surface of the wall of chamber 12 facing the combustion chamber 32 is covered with a heat resistant material 40, for example a refractory material.

Recirculation sleeve 26 is disposed on fuel/oxidant outlet side 25 of chamber 12 and comprises a combustion products inlet end 31 and a recirculated combustion products outlet end 30. As shown in FIG. 1, recirculation sleeve 26 is oriented such that recirculated combustion products outlet end 30 is oriented in the direction of the at least one wall 11 and disposed at a distance therefrom. In accordance with one preferred embodiment of this invention, recirculation sleeve 26 is in the form of a hollow cylinder coaxially disposed with respect to the burner axis 28. It will be apparent to those skilled in the art that any means for maintaining recirculation sleeve 26 in the desired position relative to burner 10 may be employed. In accordance with one preferred embodiment of this invention, recirculation sleeve 26 is connected by connection means 27, for example brackets, to wall 11.

Figure 2:
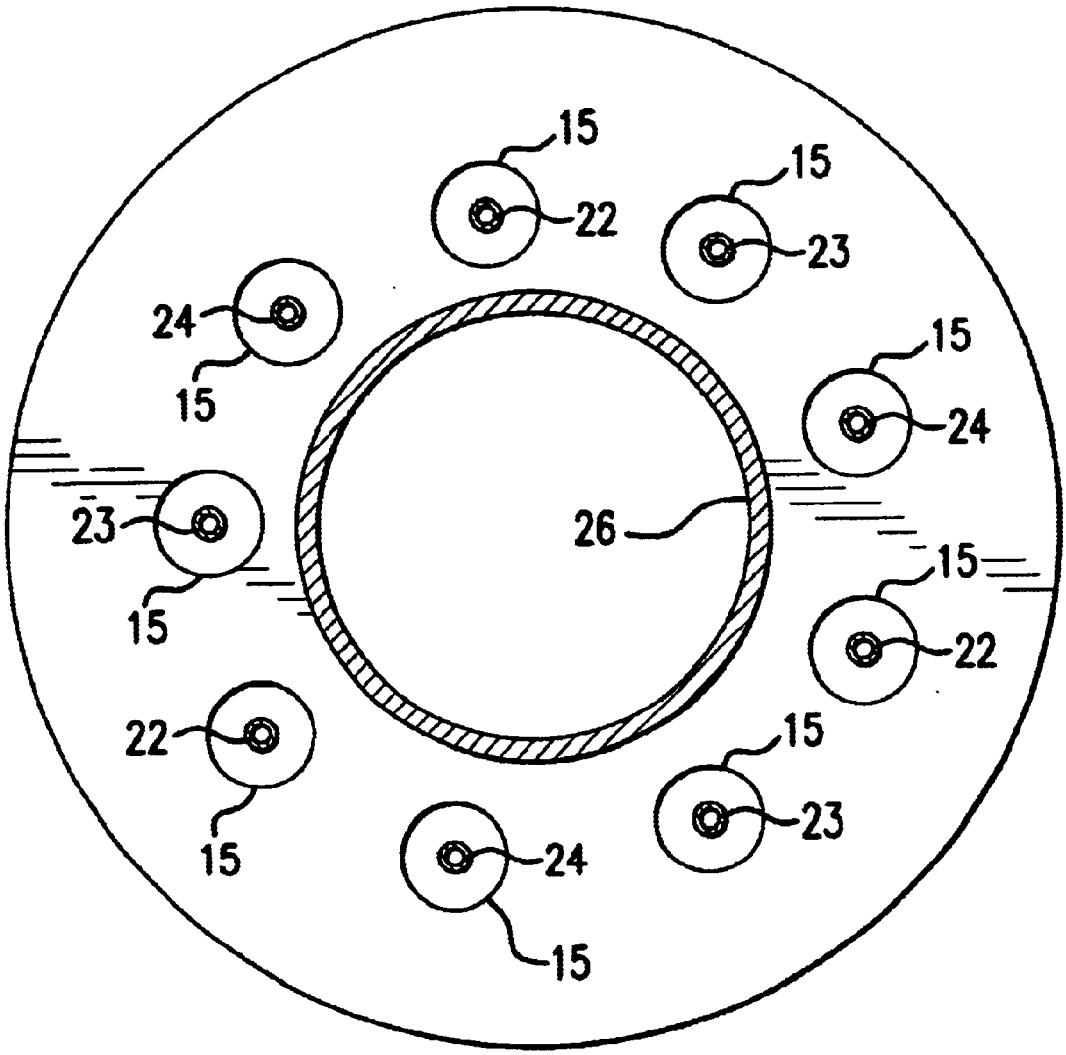
FIG. 2 is a view of the burner shown in FIG. 1 taken along the line II—II.

FIG. 2 shows the burner of FIG. 1 taken along the line II—II. As can be seen, fuel outlets 22, 23, 24, each of which corresponds to a different combustion stage and a different fuel/oxidant outlet opening 15, are disposed radially around burner axis 28 and equidistant therefrom. Also as shown in FIG. 2, the different combustion stages are alternatingly disposed around burner axis 28. That is, fuel outlet 22, which corresponds to one combustion stage, is disposed next to fuel outlet 23, which corresponds to a different combustion stage; and fuel outlet 23 is disposed next to fuel outlet 24, which corresponds to a third combustion stage. Or, to state it another way, each fuel outlet corresponding to one combustion stage is adjacent to a fuel outlet that corresponds to a different combustion stage. Also as shown in FIG. 2, recirculation sleeve 26 is coaxially disposed around burner axis 28 and has an outer radius that is smaller than the radius on which fuel outlets 22, 23, 24 are disposed.

Figure 3:
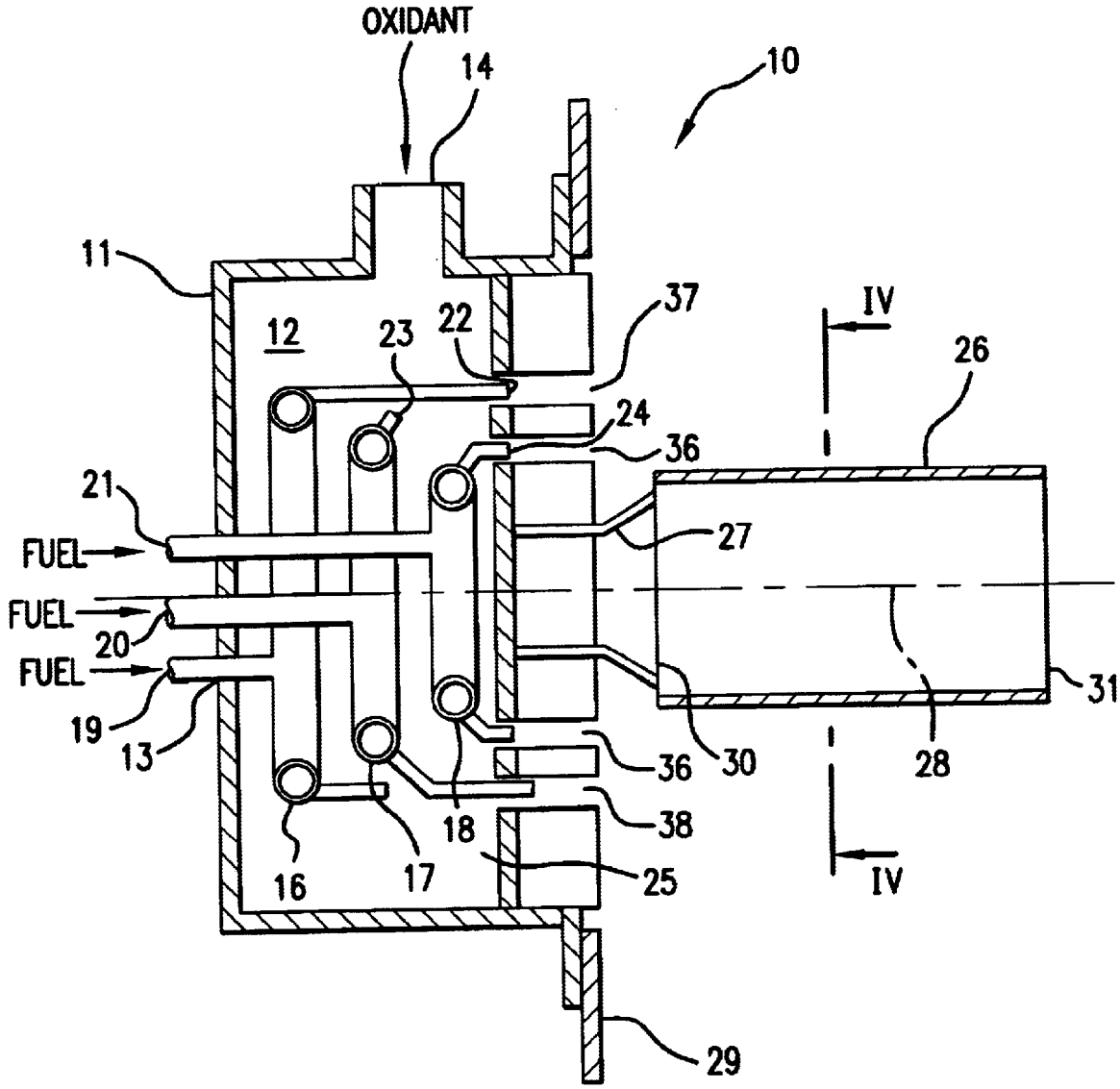
FIG. 3 is a partial cross-sectional side view of a staged combustion burner in accordance with another embodiment of this invention.
Figure 4:
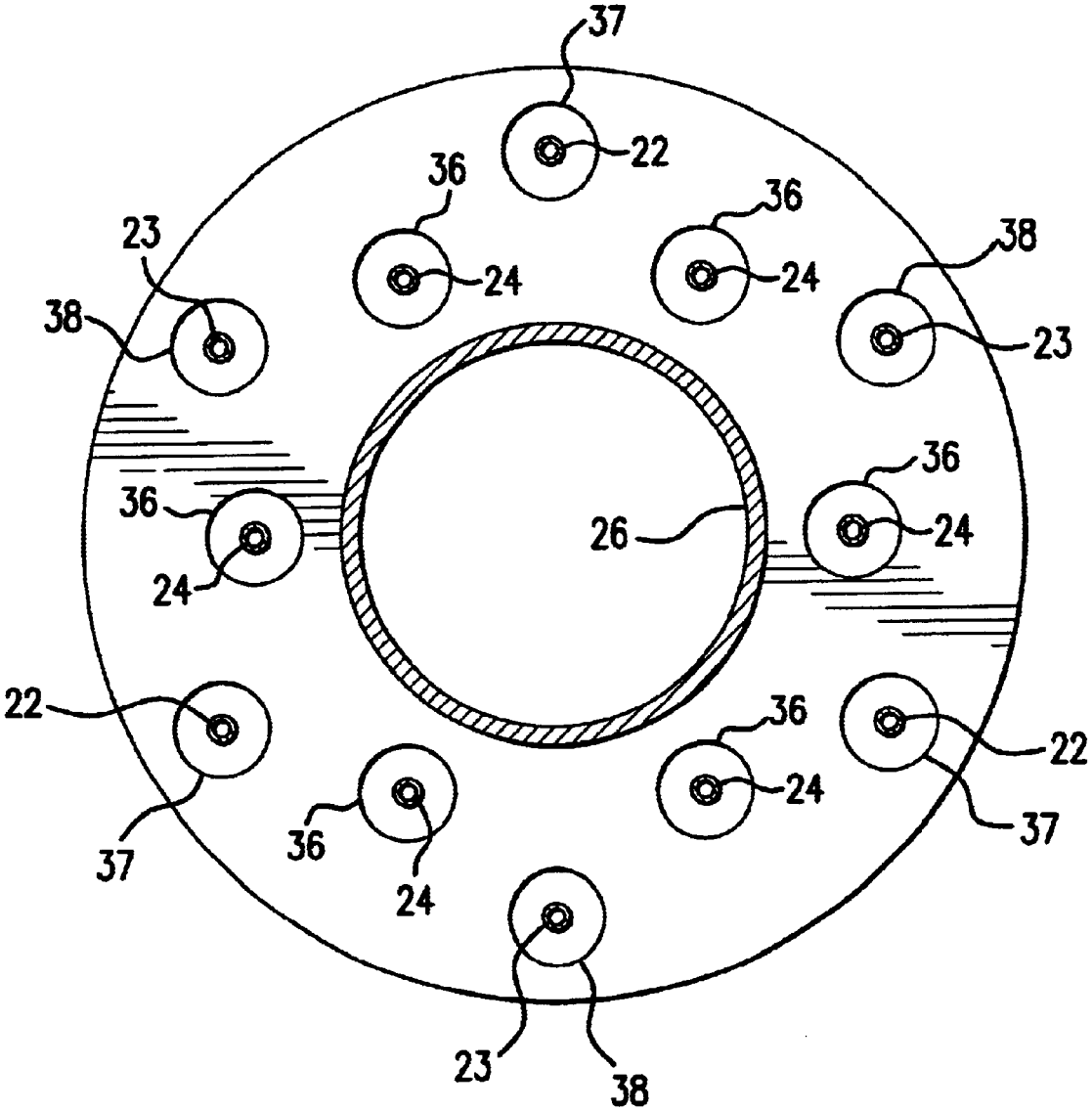
FIG. 4 is a view of the burner shown in FIG. 3 taken along the line IV—IV

A second embodiment of the burner of the invent ion claimed herein is shown in FIG. 3. As in the embodiment shown in FIG. 1, the burner shown in FIG. 3 comprises three stages and employs nozzle-mixing to provide different fuel-oxidant ratios in each of the three stages. First stage fuel/oxidant outlet openings or nozzles 36 are located on the smaller of two radii with respect to burner axis 28, and second stage nozzles 37 and third stage nozzles 38 are located on the larger of the two radii. The fuel outlets 24 of fuel distributor 18 are aligned with nozzles 36 and fuel outlets 23 and 22 of fuel distributors 17 and 16, respectively, are aligned with second and third stage nozzles 37 and 38. As shown in FIG. 4, the fuel outlets 22 and 23 associated with second and third stage nozzles 37 and 38 are disposed in an alternating fashion, as described in connection with the embodiment shown in FIG. 2. As in the first embodiment of this invention described hereinabove, recirculation sleeve 26 has a radius that is smaller than the radius on which the first stage nozzles 36 are located.

Figure 5:
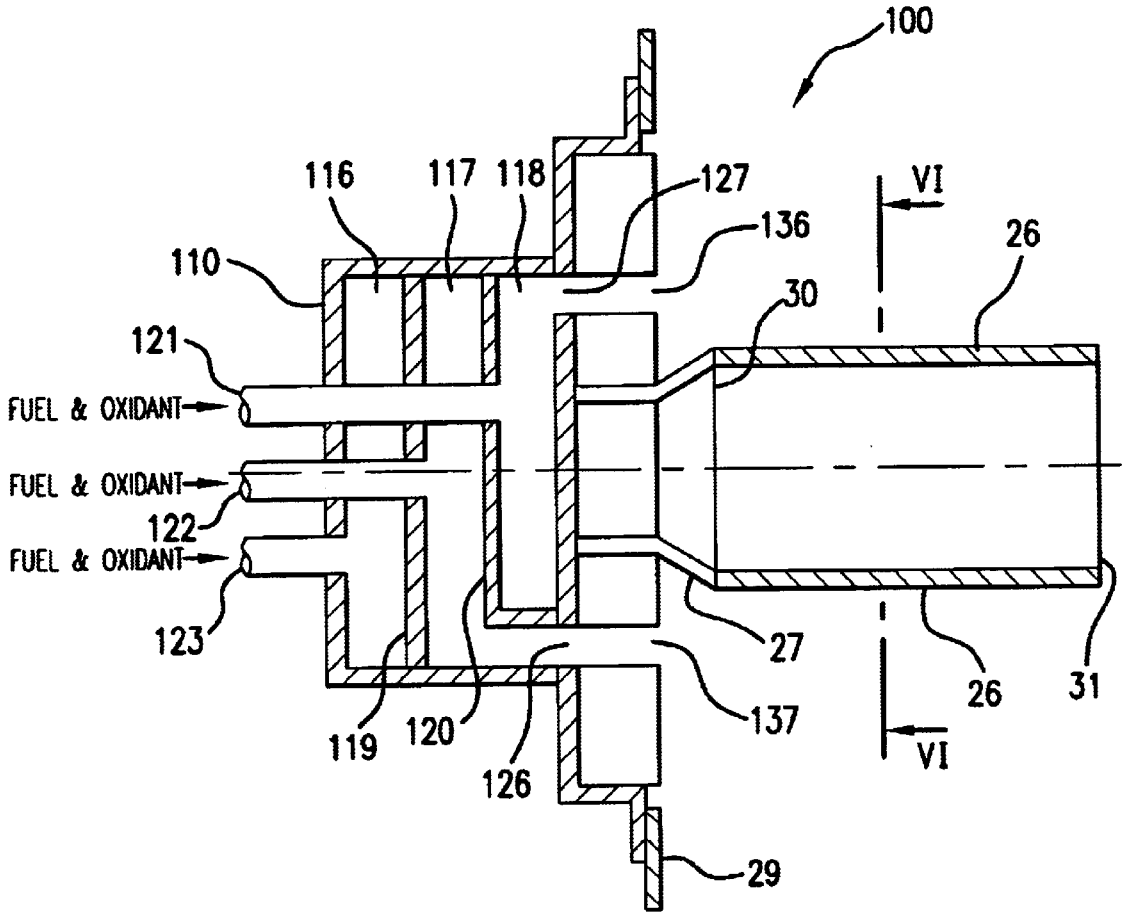
FIG. 5 is a partial cross-sectional side view of a staged combustion burner in accordance with another embodiment of this invention.
Figure 6:
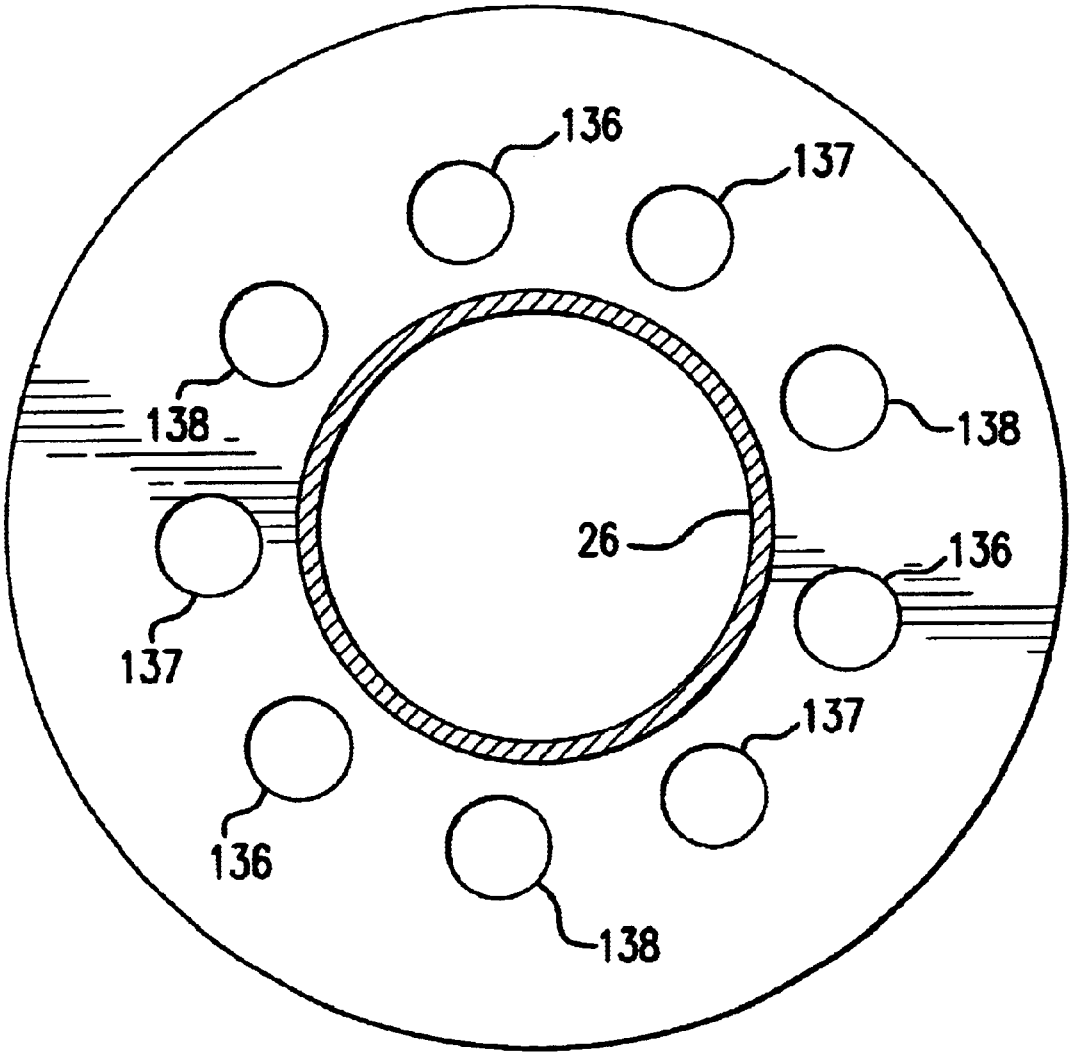
FIG. 6 is a view of the burner shown in FIG. 5 taken along the line VI—VI.

In the embodiment of the invention shown in FIG. 5, wall 110 encloses a chamber which is divided into three fuel distributor chambers 116, 117 and 118 by walls 119 and 120. In contrast to the embodiment of the invention shown in FIGS. 1 and 3 in which nozzle-mixing of the fuel and oxidant is employed, the fuel and oxidant are premixed and introduced into fuel distributor chambers 116, 117 and 118 through fuel/oxidant mixture inlets 123, 122 and 121, respectively. Each of the fuel distributor chambers 116, 117 and 118 has a fuel/oxidant mixture outlet which is aligned with one of the nozzles 136, 137 and 138 as shown in FIG. 6. Similar to the embodiment of FIG. 1, all of the nozzles 136, 137 and 138 are located on the same radius, that is they are equidistant, with respect to the burner axis 28. Also similar to the embodiment of FIG. 1, the nozzles associated with the different stages are alternatingly distributed around burner axis 28 and the radius of the recirculation sleeve 26 is smaller than the radius on which the nozzles are located.

Figure 7:
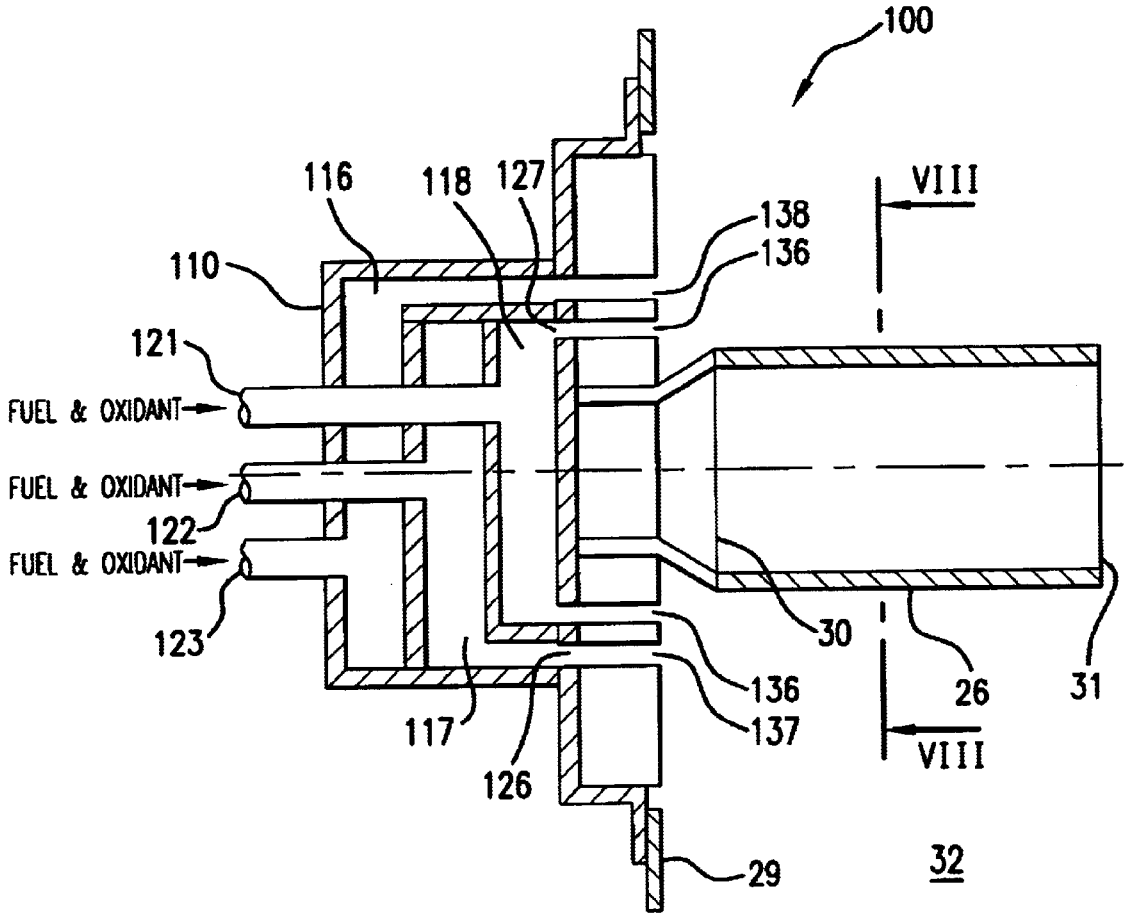
FIG. 7 is a partial cross-sectional side view of a staged combustion burner in accordance with yet another embodiment of this invention.
Figure 8:
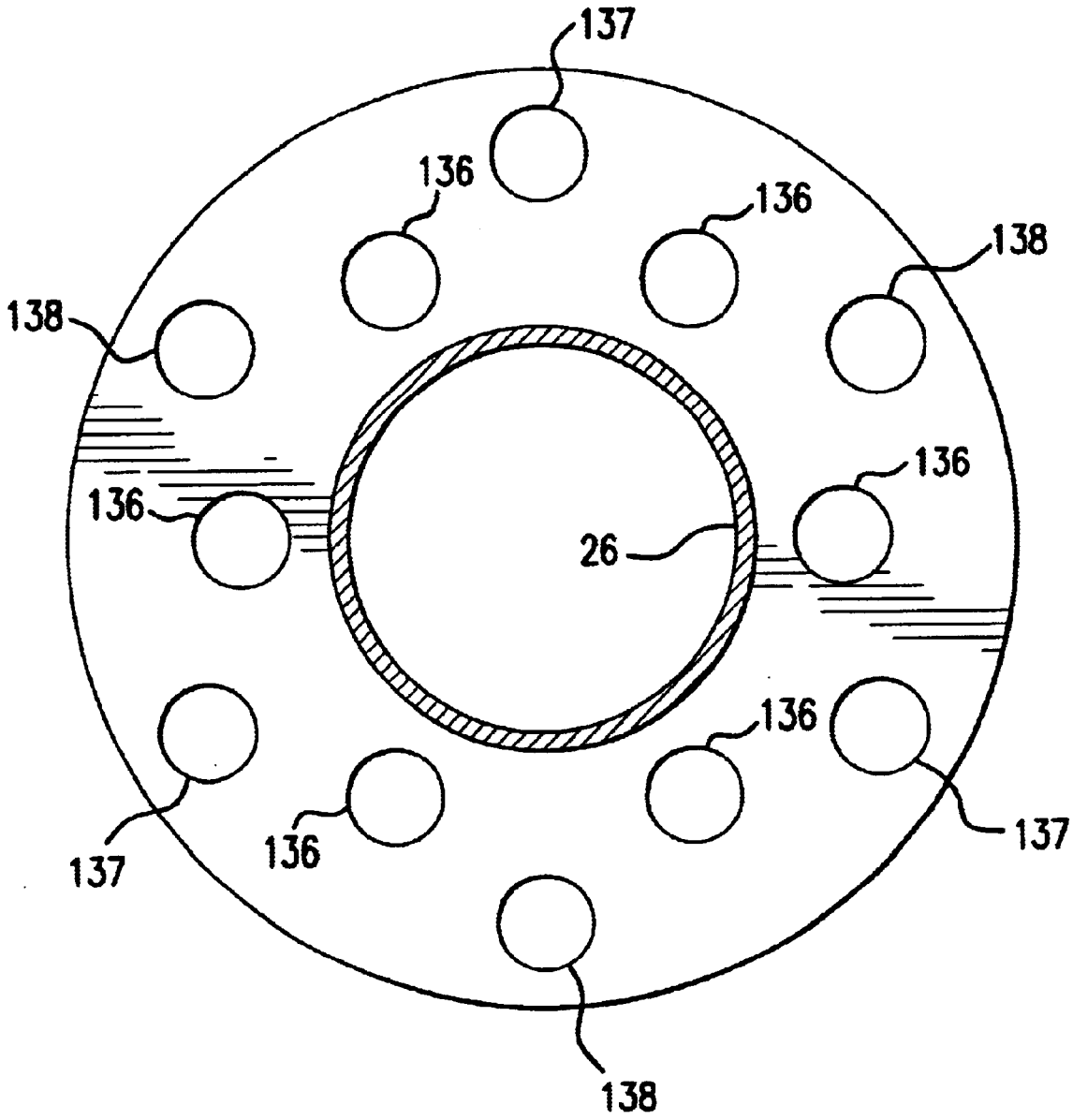
FIG. 8 is a view of the burner shown in FIG. 7 taken along the line VIII—VIII.

FIG. 7 shows another preferred embodiment of this invention in which three stages are employed and the fuel and oxidant are premixed to provide different fuel-oxidant ratios in each of the three stages. The primary difference between the embodiment shown in FIG. 7 and the embodiment shown in FIG. 5 is the disposition of the first, second and third stage nozzles 136, 137 and 138. As shown in FIG. 8, the first stage nozzles 136 are disposed on the smaller of two radii with respect to burner axis 28 whereas the second and third stage nozzles 137 and 138, respectively, are disposed on the larger of the two radii with respect to burner axis 28. As in the embodiment of this invention shown in FIG. 4, the second and third stage nozzles 137 and 138 are alternatingly disposed on the larger of the two radii. Also, as shown in FIG. 8, recirculation sleeve 26 is disposed coaxially with respect to burner axis 28 and comprises a radius that is smaller than the radius on which the first stage nozzles are located.

While in the foregoing specification this invention has been described in relation to certain preferred embodiments thereof, and many details have been set forth for the purpose of illustration, it will be apparent to those skilled in the art that the invention is susceptible to additional embodiments and that certain of the details described herein can be varied considerably without departing from the basic principles of this invention.

We claim:

1. An imaging dcvicc formed as an integrated circuit comprising:

a photosensitive device far accumulating photo-generated charge having a generally diagonally shaped component contacting a column output line in an underlying portion of a semiconductor substrate; and a readout circuit comprising at least an output transistor;

wherein said imaging device is in a row of similar imaging devices in an array and shares said column output line with an adjacent imaging device of the row.

2. The imaging device according to claim 1, wherein said photosensitive device is selected from, the group consisting of a photogate, a photodiode and a photoconductor.

3. The imaging device according to claim 1, wherein said photosensitive device includes a photodiode.

4. The imaging device according to claim 1, wherein said photosensitive device includes a photoconductor.

5. The imaging device according to claim 1, further comprising a controllable charge transfer region having a control terminal, said transfer region being formed in said substrate adjacent said photosensitive area and having a node connected to a gate of said output transistor and at least one charge transfer device for transferring charge from said photosensitive area to said node in accordance with a control signal applied to said control terminal.

6. The imaging device according to claim 5, wherein said charge transfer device is a field effect transistor.

7. The imaging device according to claim 1, further comprising a straight column line formed of a metal layer in an integrated circuit to address said imaging device.

8. The imaging device according to claim 5, further comprising a reset transistor for resetting said node in response to a reset signal.

9. The imaging device according to claim 8, wherein said reset transistor is addressed by a reset line which is linear in said substrate.

10. The imaging device according to claim 9, wherein said reset line is formed of a material selected from the group consisting of doped polysilicon, metals and refractory metal silicides.

11. The imaging device according to claim 9, further comprising a row select transistor responsive to a row select signal to activate said imaging device.

12. The imaging device according to claim 11, wherein said row select transistor is addressed by a row select line which is linear in said substrate.

13. The imaging device according to claim 12, wherein said row select line is formed of a material selected from thc group consisting of doped polysilicon, metals, refractory metal silicides and mixtures thereof.

14. A method for generating an outpnt signal corresponding to an image focused on a sensor array having rows and columns of pixel sensors on a substrate wherein two adjacent pixel sensors in a row are connected to a shared column line, each sensor capable of collecting electrical charge based on a detected light intensity, the method comprising the steps of:

activating a first sensor in a row connected to a shared column line for a first period of time then subsequently activating an adjacent second sensor in the row connected to said shared column line for a second period of time;

detecting a first voltage at a node of a respective activated sensor;

resetting the voltage of the respective nodes of said activated sensors to a predetermined voltage, wherein said voltage is reset by a reset transistor addressed by a reset line which is linear in said substrate;

transferring electrical charges collected by said activated sensor to said node;

generating an output signal over said shared column line.

15. The method for generating an output signal according to claim 14, wherein said sensor is selected from the group consisting of a photogate, a photodiode and a photoconductor.

16. The method for generating an output signal according to claim 14, wherein said node is a floating diffusion node.

17. The method for generating an output signal according to claim 14, wherein said shared column line is formed of a metal layer.

18. The method for generating an output signal according to claim 14, wherein said shared column line is linear in said substrate.

19. The method for generating an output signal according to claim 14, wherein said reset transistor is addressed by a reset line which is linear in said substrate.

20. The method for generating an output signal according to claim 19, wherein said reset line is formed of a material selected from the group consisting of doped polysilicon, metals, refractory metal silicides and mixtures thereof.

21. The method for generating an output signal according to claim 14, wherein said row select transistor is addressed by a row select line which is linear in said substrate.

22. The method for generating an output signal according to claim 21, wherein said row select line is formed of a material selected from the group consisting of doped polysilicon, metals, refractory metal silicides and mixtures thereof.

23. An imaging system comprising:

a plurality of pixel cells having an active sensor area which includes a diagonally shaped component, the cells being arranged into an array of rows and columns, each pixel cell being operable to generate a voltage at a diffusion node corresponding to detected light intensity by the sensor, wherein two cells in a row share a common column line for addressing said pixel cell and the pixel cells in the row that share the common column line are alternatively addressed by respective row select lines;

a row select device connected to either an odd row select line or an even row select line respectively; and a row decoder having a plurality of control lines connected to the pixel cells, each control line being connected to the cells in contact with a respective column, wherein the row decoder is operable to activate odd cells in said rows and even cells in said rows by said row select device.

24. The imaging system according to claim 23, further comprising:

a reset device to reset the voltage of a diffusion node formed in the cells;

a transfer device to transfer charge form said pixel cells to said diffusion node;

a plurality of output circuits respectively connected to a pixel cell, each output circuit being operable to store a voltage signal received from a respective pixel cell and to provide a sensor output signal.

25. The imaging system according to claim 23, wherein said pixel cells include a photogate, a photodiode or a photoconductor in said active area.

26. Thc imaging system according to claim 24, wherein the diffusion node is a floating diffusion node.

27. The imaging system according to claim 23, wherein said column line addressing two adjacent rows of pixel cells is linear in said substrate.

28. The imaging device according to claim 27, wherein said column line is formed of a metal.

29. The imaging system according to claim 24, wherein said reset device is addressed by a reset line which is linear in said substrate.

30. The imaging system according to claim 29, wherein said reset line is formed of a material selected from the group consisting of doped polysilicon, metals, refractory metal silicides and mixtures thereof.

31. The imaging system according to claim 24, wherein said row select device is addressed by a row select line which is linear in said substrate.

32. The imaging system according to claim 31, wherein said row select line is formed of a material selected from the group consisting of doped polysilicon, metals, refractory metal silicides and mixtures thereof.

33. A CMOS imager array comprising:

a plurality of CMOS imager pixels for generating an output signal from detected light and arranged in rows and columns in an array;

a plurality of column lines each connected to at least two adjacent pixels of a row in said array, said column lines being connected to output circuitry to output signals generated from detected light;

a plurality of odd row select lines orthogonal to said column lines to address odd pixels in said rows;

a plurality of even row select lines orthogonal to said column lines to address even pixels in said rows;

column drivers to address the pixels connected to said column lines;

row drivers to address he pixels through said odd row lines and said even row lines.

34. The CMOS imager array according to claim 33, wherein said plurality of CMOS imager pixels have an active area having a diagonally shaped component.

35. The CMOS imager array according to claim 33, wherein said column line is linear in said array.

36. The CMOS imager array according to claim 34, wherein said column line is formed of a metal.

37. The CMOS imager array according to claim 33, wherein said odd row lines and said even row lines are is linear in said array.

38. The CMOS imager array according to claim 36, wherein said odd and even row select lines are formed of materials selected from the group consisting of doped polysilicon, metals, retractory metal silicides and mixtures thereof.

39. A system comprising:

(i) a processor; and (ii) a CMOS imaging device coupled to said processor and including:

a photosensitive device for accumulating photo-generated charge in an underlying portion of a semiconductor substrate, wherein the photosensitive area of said imaging devices sharing a column line is generally S-shaped; and a readout circuit comprising at least an output transistor;

wherein said imaging device is in a row of similar imaging devices in an array and shares a column output line with an adjacent imaging device of the row.

40. The system according to claim 39, wherein said photosensitive device seleted from the group consisting of a photogate, a photodiode and a photoconductor.

41. The system according to claim 39, wherein said photosensitive device includes an active area for accumulating photo-generated charge having a generally diagonally shaped component.

42. The system according to claim 39, further comprising a controllable charge transfer region having a control terminal, said transfer region being formed in said substrate adjacent said photosensitive area and having a node connected to a gate of said output transistor and at least one charge transfer device for transferring charge from said photosensitive area to said node in accordance with control signal applied to said control terminal.

43. The system according to claim 42, wherein said charge transfer device is a field effect transistor.

44. The system according to claim 39, further comprising a straight column line formed of a metal layer in a substrate to address said imaging device.

45. The system according to claim 42, further comprising a reset transistor for resetting said node in response to a reset signal.

46. The system according claim 45, wherein said reset transistor is addressed by a reset line which is linear in said substrate.

47. The system according to claim 46, wherein said reset line is formed of a material selected from the group consisting of doped polysilicon, metals, refractory metal silicides and mixtures thereof.

48. The system according to claim 46, further comprising a row select transistor responsive to a row select signal to activate said imaging device.

49. The system according to claim 48, wherein said row select transistor is addressed by a row select line which is linear in said substrate.

50. The system according to claim 49, wherein said row select line is formed of a material selected from the group consisting of doped polysilicon, metals, refractory metal silicides and mixtures thereof.

51. The system according to claim 39, wherein said system is a camera system.

52. The system according to claim 39, wherein said system is a scanner.

53. Thc system according to claim 39, wherein said system is a machine vision system.

54. The system according to claim 39, wherein said system is a vehicle navigation system.

55. The system according to claim 39, wherein said system is a video telephone system.

* * * * *

UNITED STATES PATENT AND TRADEMARK OFFICE

CERTIFICATE OF CORRECTION

PATENT NO. : 6,672,859 B1
DATED : January 6, 2004
INVENTOR(S) : Rabovitser et al.

It is certified that error appears in the above-identified patent and that said Letters Patent is hereby corrected as shown below:

Column 7,
Line 13, delete Claims 1-55 and insert the following Claims 1-35,

-- 1. An apparatus comprising:

at least one wall enclosing a chamber and forming at least one fuel inlet opening, at least one oxidant inlet opening and a plurality of fuel/oxidant outlet openings, said plurality of fuel/oxidant outlet openings formed by a portion of said at least one wall disposed on a fuel/oxidant outlet side of said chamber and disposed at at least one radial distance from a center axis of said apparatus;

a recirculation sleeve disposed on said fuel/oxidant outlet side of said chamber and coaxially aligned with said center axis, said recirculation sleeve having a combustion products inlet end and a recirculated combustion products outlet end, said recirculated combustion products outlet end oriented in a direction of said at least one wall and disposed at a distance from said at least one wall; and a plurality of fuel distributors disposed within said chamber, each of said fuel distributors having a fuel inlet and a plurality of fuel outlets, each said fuel outlet aligned with a corresponding one of said fuel/oxidant outlet openings.

---

2. An apparatus in accordance with Claim 1, wherein said fuel/oxidant outlet openings are disposed equidistant from said center axis.

3. An apparatus in accordance with Claim 1, wherein said fuel/oxidant outlet openings form a plurality of circular rings around said center axis.

4. An apparatus in accordance with Claim 1, wherein said recirculation sleeve is a hollow cylinder having a radius less than said radial distance.

5. An apparatus in accordance with Claim 1, wherein said at least one fuel opening and said at least one oxidant inlet opening coincide.

6. An apparatus in accordance with Claim 1, wherein said plurality of fuel outlets are disposed in a single plane normal to said center axis.

7. An apparatus in accordance with Claim 1, wherein at least one of said fuel distributors comprises an oxidant inlet.

8. An apparatus in accordance with Claim 1, wherein each of said fuel distributors comprises an oxidant inlet.

---

It is certified that error appears in the above-identified patent and that said Letters Patent is hereby corrected as shown below:

9. An apparatus in accordance with Claim 1, wherein said fuel/oxidant outlet openings are disposed at a plurality of radial distances from said center axis of said apparatus.

10. An apparatus comprising:

at least one combustion chamber wall enclosing a combustion chamber and forming at least one burner opening; and at least one multi-stage burner having a plurality of transversely disposed combustion stages, at least one fuel inlet opening, at least one oxidant inlet opening and a plurality of fuel/oxidant outlet openings corresponding to each of said combustion stages, said at least one multi-stage burner attached to said at least one combustion chamber wall and said plurality of fuel/oxidant outlet openings in fluid communication with said at least one burner opening.

11. An apparatus in accordance with Claim 10, wherein said fuel/oxidant outlet openings are disposed in a single plane.

12. An apparatus in accordance with Claim 10, wherein said multi-stage burner further comprises a plurality of fuel distributors, each of said fuel distributors having a fuel inlet and a plurality of fuel outlets and each of said fuel outlets aligned with a corresponding one of said fuel/oxidant outlets.

13. An apparatus in accordance with Claim 12, wherein said at least one multi-stage burner comprises at least one burner wall enclosing a burner chamber and forming said at least one fuel inlet opening, said at least one oxidant inlet opening and said plurality of fuel/oxidant outlet openings, and said plurality of fuel distributors are disposed within said burner chamber.

14. An apparatus in accordance with Claim 10, wherein said fuel/oxidant outlet openings are disposed at at least one radial distance from a center axis of said at least one multi-stage burner.

15. An apparatus in accordance with Claim 10, wherein said fuel/oxidant outlet openings are disposed at one radial distance from a center axis of said at least one multi-stage burner.

16. An apparatus in accordance with Claim 10 further comprising a recirculation sleeve disposed in said combustion chamber and coaxially aligned with a center axis of said at least one multi-stage burner.

17. An apparatus in accordance with Claim 16, wherein said recirculation sleeve is attached to one of said combustion chamber wall and said at least one multi-stage burner.

UNITED STATES PATENT AND TRADEMARK OFFICE

CERTIFICATE OF CORRECTION

PATENT NO. : 6,672,859 B1
DATED : January 6, 2004
INVENTOR(S) : Rabovitser et al.

It is certified that error appears in the above-identified patent and that said Letters Patent is hereby corrected as shown below:

18. An apparatus in accordance with Claim 14, wherein said recirculation sleeve is a hollow cylinder having an outer radius less than said radial distance from said center axis.

19. A method for combustion of a fuel comprising the steps of:

introducing a plurality of fuel streams into a combustion chamber, said fuel streams penetrating at at least two different axial lengths into said combustion chamber;

introducing an oxidant into said combustion chamber;

igniting said fuel in said combustion chamber, resulting in formation of a flame and combustion products; and recirculating at least a portion of said combustion products to a base region of said flame.

20. A method in accordance with Claim 19, wherein said fuel streams penetrate to three different said axial lengths into said combustion chamber, a shortest of said axial lengths corresponding to a first fuel stage, a next longest of said axial lengths corresponding to a second fuel stage, and a longest of said axial lengths corresponding to a third fuel stage.

21. A method in accordance with Claim 20, wherein said first fuel stage extends in a range of about 5% to about 15% of a combustion chamber length, said second fuel stage extends in a range of about 20% to about 40% of said combustion chamber length, and said third fuel stage extends in a range of about 35% to about 55% of said combustion chamber length.

22. A method in accordance with Claim 20, wherein said first fuel stage comprises in a range of about 1% to about 20% of a total amount of said fuel, said second fuel stage comprises in a range of about 30% to about 60% of said total amount of said fuel, and said third fuel stage comprises in a range of about 20% to about 50% of said total amount of said fuel.

23. A method in accordance with Claim 20, wherein said first fuel stage has a stoichiometric oxidant-fuel ratio in a range of about 0.3 to about 0.5, said second fuel stage has a stoichiometric oxidant-fuel ratio in a range of about 0.6 to about 0.8, and said third fuel stage has a stoichiometric oxidant-fuel ratio in a range of about 1.4 to about 1.7.

24. A method in accordance with Claim 19, wherein said fuel and oxidant are premixed.

It is certified that error appears in the above-identified patent and that said Letters Patent is hereby corrected as shown below:

25. A method in accordance with Claim 19, wherein said fuel and oxidant are nozzle-mixed.

26. A method in accordance with Claim 19, wherein said fuel is selected from a group consisting of natural gas, propane, hydrogen, producer gas, synthesis gas, coke oven gas, blast furnace gas, hydrocarbon liquids and mixtures thereof.

27. A method in accordance with Claim 19, wherein said fuel streams are introduced into said combustion chamber through an array of nozzles having a form selected from the group consisting of circular, ellipsoid and rounded rectangle disposed around a center burner axis.

28. A method in accordance with Claim 27, wherein said fuel streams penetrate to three different said axial lengths into said combustion chamber, a shortest of said axial lengths corresponding to a first fuel stage, a next longest of said axial lengths corresponding to a second fuel stage, and a longest of said axial lengths corresponding to a third fuel stage.

29. A method in accordance with Claim 28, wherein each of said nozzles corresponds to one of said first fuel stage, said second fuel stage and said third fuel stage.

30. A method in accordance with Claim 28, wherein said nozzles are disposed in a circular said array around said center burner axis with each of said nozzles corresponding to a different said fuel stage than an adjacent said nozzle.

31. A method in accordance with Claim 30, wherein said nozzles corresponding to different said fuel stages are disposed at different said radial distances from said center burner axis.

32. A method in accordance with Claim 28, wherein said fuel to at least one of said fuel stages is preheated.

33. A method in accordance with Claim 19, wherein said fuel streams penetrate to two different axial lengths into said combustion chamber, which two different axial lengths correspond to two different fuel stages and said oxidant is introduced as an oxidant stream into said combustion chamber, which oxidant stream penetrates to a different axial lengths than said fuel streams.

34. A method in accordance with Claim 20, wherein said fuel stages are oriented transversely to a center burner axis.

UNITED STATES PATENT AND TRADEMARK OFFICE

CERTIFICATE OF CORRECTION

PATENT NO. : 6,672,859 B1
DATED : January 6, 2004
INVENTOR(S) : Rabovitser et al.

It is certified that error appears in the above-identified patent and that said Letters Patent is hereby corrected as shown below:

35. A method in accordance with Claim 19, wherein at least a portion of said oxidant is preheated. --

Signed and Sealed this

Seventh Day of September, 2004

JON W. DUDAS
*Director of the United States Patent and Trademark Office*